US010595616B2

(12) United States Patent
Kravchenko

(10) Patent No.: US 10,595,616 B2
(45) Date of Patent: Mar. 24, 2020

(54) DIAPER CREAM APPLICATOR WITH LID

(71) Applicant: Alina Kravchenko, Houston, TX (US)

(72) Inventor: Alina Kravchenko, Houston, TX (US)

( * ) Notice: Subject to any disclaimer, the term of this patent is extended or adjusted under 35 U.S.C. 154(b) by 0 days.

(21) Appl. No.: 16/216,117

(22) Filed: Dec. 11, 2018

(65) Prior Publication Data

US 2019/0104825 A1 Apr. 11, 2019

Related U.S. Application Data

(60) Provisional application No. 62/658,234, filed on Apr. 16, 2018.

(51) Int. Cl.

| | |
|---|---|
| ***B65D 51/24*** | (2006.01) |
| ***B65D 47/44*** | (2006.01) |
| ***B65D 47/20*** | (2006.01) |
| ***A45D 34/04*** | (2006.01) |
| ***A45D 40/02*** | (2006.01) |
| ***A45D 40/26*** | (2006.01) |

(52) U.S. Cl.

CPC ..... *A45D 40/26* (2013.01); *A45D 34/04* (2013.01); *B65D 47/2031* (2013.01); *B65D 47/44* (2013.01); *B65D 51/249* (2013.01); *A45D 2200/10* (2013.01)

(58) Field of Classification Search

CPC .... A45D 40/262; A45D 40/26; A45D 40/261; A45D 34/04; A45D 2200/1009; A45D 2200/10; A45D 2040/0012; A45D 2034/007; A45D 34/00; B65D 51/249; B65D 51/26; B65D 47/44; B65D 47/42; B65D 47/2031; A45F 2200/05

See application file for complete search history.

(56) References Cited

U.S. PATENT DOCUMENTS

| | | | | |
|---|---|---|---|---|
| 3,817,426 | A | 6/1974 | Fooks | |
| 5,263,787 | A | 11/1993 | Wilcox | |
| 5,348,543 | A | 9/1994 | Talley | |
| 5,879,095 | A * | 3/1999 | Gueret | A45D 34/042 401/172 |
| 6,305,864 | B1 | 10/2001 | Nguyen | |
| 7,685,766 | B2 * | 3/2010 | Amsellem | A01G 29/00 47/48.5 |
| 8,920,059 | B2 * | 12/2014 | Kravchenko | A45D 40/22 401/131 |

* cited by examiner

*Primary Examiner* — David J Walczak
(74) *Attorney, Agent, or Firm* — Scott Fagerland

(57) ABSTRACT

An improved applicator apparatus and lid facilitate one-handed application of diaper rash cream or other therapeutic cream from a squeeze tube. Two sets of female screw threads fit two common neck diameters for squeeze tubes. A nozzle and a soft, flexible, concave tip with opening flap provide smooth and even application of cream. A convex tongue, curved complementary to the concave tip, is attached to the lid's interior. When a squeeze tube is attached to the applicator and stored in the lid, the tongue presses the tip of the applicator apparatus firmly against the opening of the nozzle, creating a leakproof and airtight seal.

6 Claims, 7 Drawing Sheets

DIAPER CREAM APPLICATOR WITH LID

1. FIELD OF THE INVENTION

This invention is a coating implement with material supply, specifically with a blade-like, pad-like, or apertured work-contacting end.

2. BACKGROUND OF THE INVENTION

Conventionally, applying ointment from a tube requires two hands. This presents difficulties when applying ointment to a baby during a diaper change. The present invention relates to a device that facilitates one-handed cream application in a sanitary, mess-free manner.

3. DESCRIPTION OF RELATED TECHNOLOGY

This invention offers improvements over the Diaper Rash Cream Applicator, the subject of U.S. Pat. No. 8,920,059 (Kravchenko). For the purposes of this description, the device described in U.S. Pat. No. 8,920,059 will be referred to as "Version 1" and the present invention will be called "Version 2".

In its preferred embodiment, the Version 1 structure comprises two parts: an applicator apparatus and a lid. The applicator apparatus has female screw threads. Before changing her baby's diaper, a mother purchases a tube of diaper rash cream, unscrews the cap, and replaces the cap with the applicator apparatus. The applicator apparatus has a hole. When the tube is squeezed, cream exits the hole of the applicator apparatus. The hole is surrounded by applicator means such as a brush or sponge. The mother wipes the brush or sponge over the baby's body.

After the cream is applied, the mother then fastens the tube/applicator apparatus into the lid. The lid is secured to a hard surface with means such as a suction cup. The applicator apparatus clicks securely into the lid and keeps the cream from drying out. Because the lid is secured to a surface, the mother can insert and remove the tube with only one hand.

4. SUMMARY OF THE INVENTION

Version 2 offers three innovations over Version 1: dual screw threads, improved cream applicator apparatus, and improved means for keeping the tube sealed while not in use.

Version 2 has two sets of female screw threads for two common neck tube diameters. Thus, a single applicator apparatus can now be fitted to squeeze tubes with "small" or "large" necks.

The improved applicator apparatus comprises a nozzle and a soft, flexible tip with opening flap. Cream emerges from the nozzle through the opening flap in the soft, flexible tip. Experimentation has shown that this construction offers smoother and more even application of cream than a brush or sponge.

To assist in keeping the tube sealed, the improved lid has a tongue, which protrudes upward from the base of the lid into the lid's interior. When the tube/applicator is inserted into the lid, the tongue presses the soft, flexible tip securely against the opening of the nozzle, creating a leakproof and airtight seal.

5. BRIEF DESCRIPTION OF THE DRAWINGS

Figure 17:
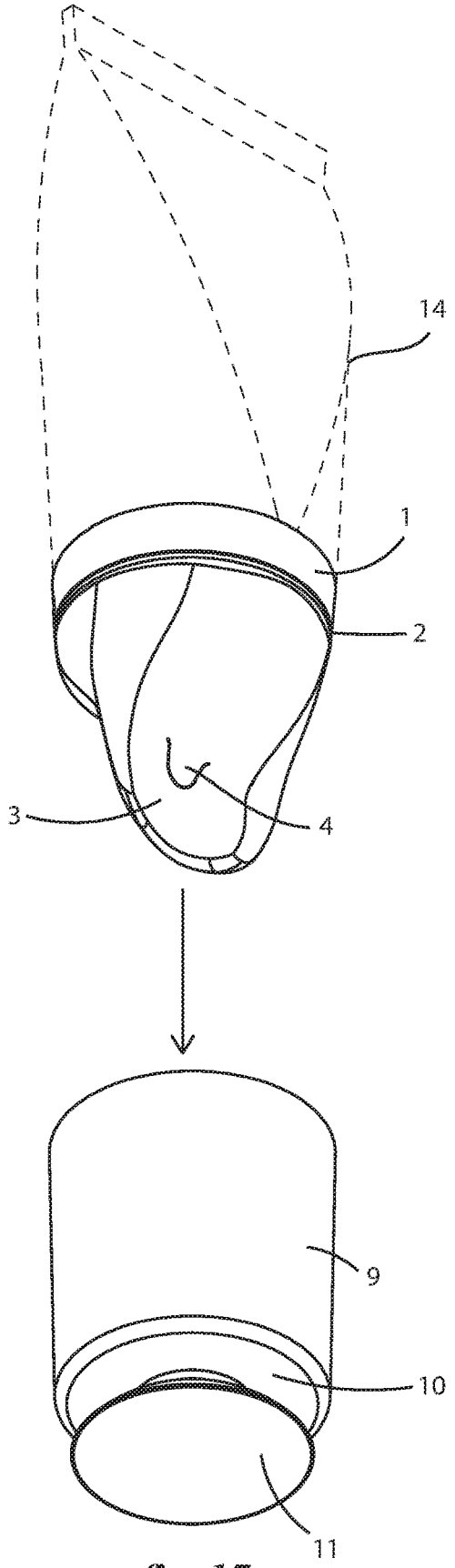

FIG. 17 is an exploded perspective view of the applicator. The arrow indicates that the applicator enters the lid. A tube of cream, not part of the claimed invention, is shown in broken lines.

Figure 18:
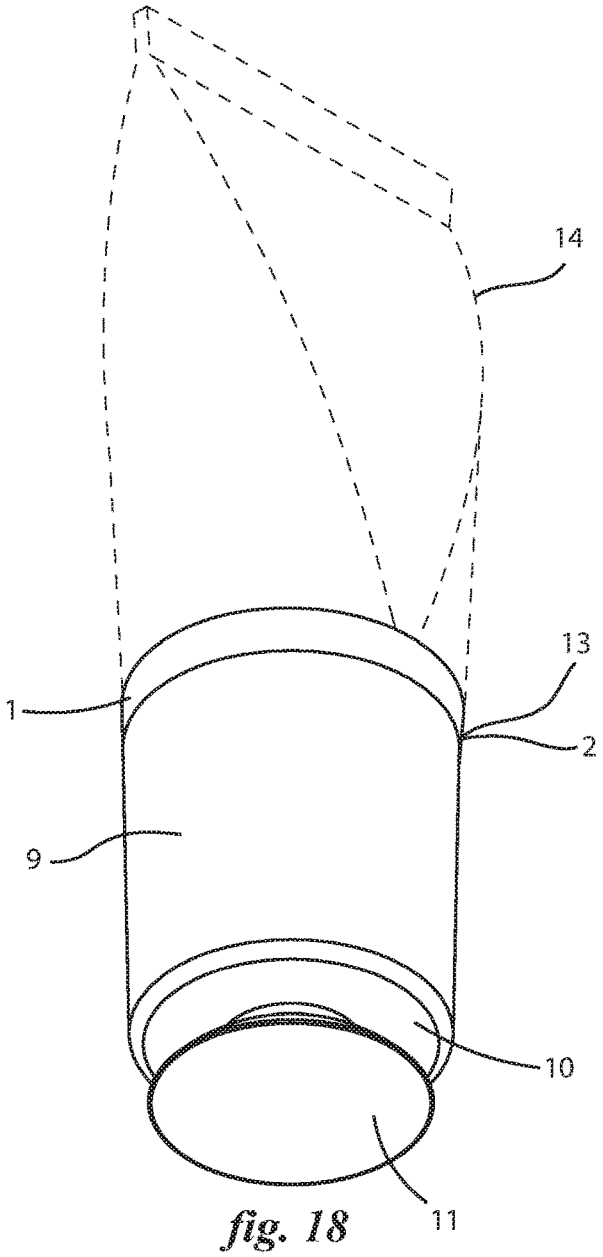

FIG. 18 is a first perspective view of the applicator secured to the lid. A tube of cream, not part of the claimed invention, is shown in broken lines.

Figure 19:
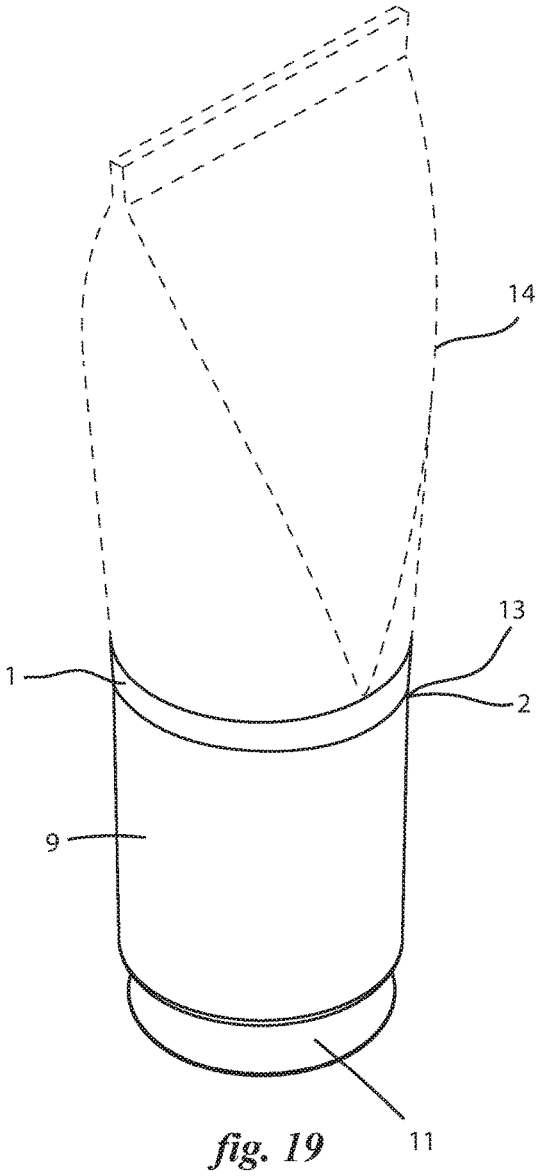

FIG. 19 is a second perspective view of the applicator secured to the lid. A tube of cream, not part of the claimed invention, is shown in broken lines.

Figure 20:
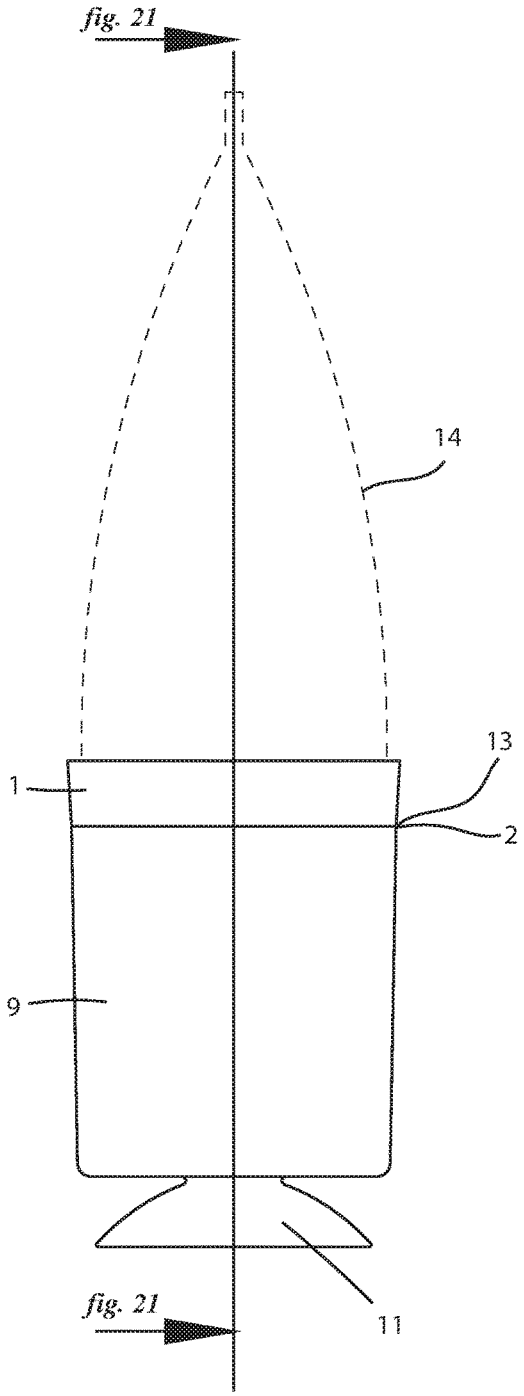

FIG. 20 is a front view of the applicator secured to the lid. A tube of cream, not part of the claimed invention, is shown in broken lines.

Figure 21:
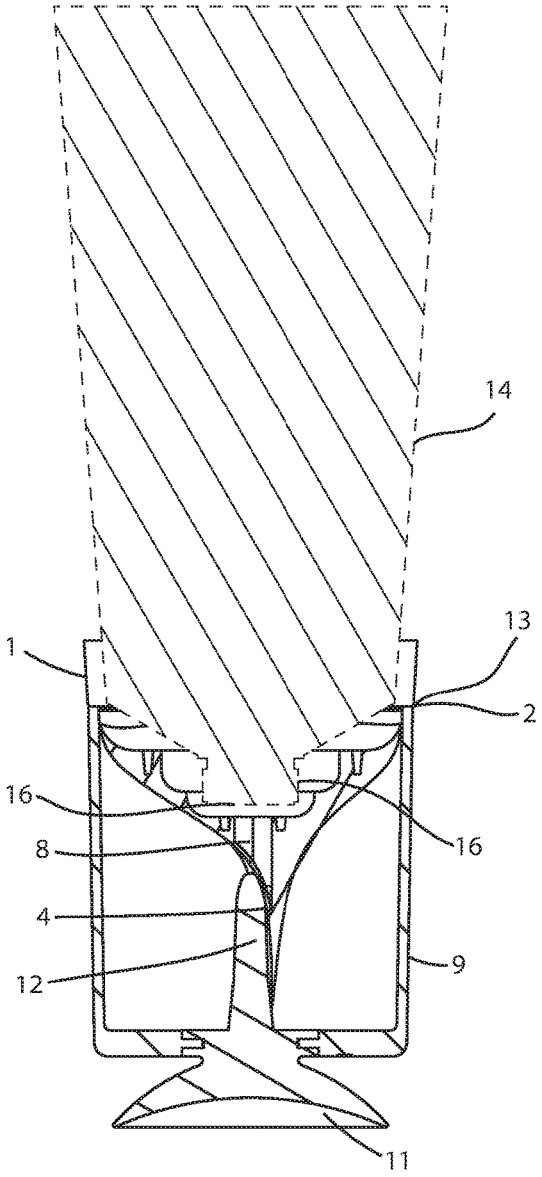

FIG. 21 is a cross-sectional view of FIG. 20. A tube of cream, not part of the claimed invention, is shown in broken lines. This tube of cream has a small neck.

Figure 22:
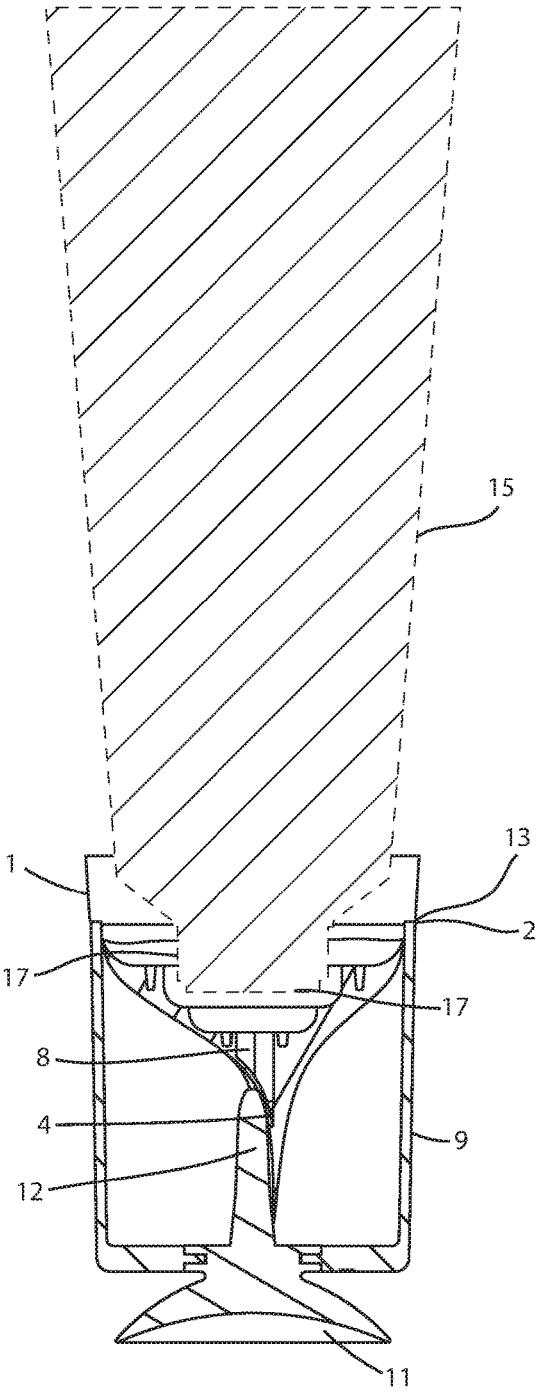

FIG. 22 is a cross-sectional view of FIG. 20. A tube of cream, not part of the claimed invention, is shown in broken lines. This tube of cream has a large neck.

6. DETAILED DESCRIPTION OF THE PREFERRED EMBODIMENTS

The invention is a cream applicator with lid. The applicator (not numbered) is shown alone in FIGS. 1-8. The lid (not numbered) is shown alone in FIGS. 9-12, 15, and 16. In its best mode, the applicator is secured to a tube of cream or ointment such as diaper rash cream, and it assists with the application of cream to human skin. For purposes of describing the invention, especially in the claims, the applicator has a proximal end, which faces the tube of cream, and a distal end, where it contacts the skin.

This invention is an improved version of the product described in U.S. Pat. No. 8,920,059 (Version 1), so its basic structure and usage is derived from Version 1. For instance, FIGS. 17-22 show the applicator screwed onto a tube of cream. Cream exits the tube through hole 7. FIGS. 13, 14, and 17-22 show the applicator secured to the lid. Indentation 2 on rim 1 snaps into place over lip 13 of lid exterior 9. The lid has a base 10 secured to suction cup 11, which secures it firmly to a table top. The lid can be described with a proximal end, which faces the applicator, and a distal end, which faces the table. These features are all in common with Version 1.

The first improved feature of Version 2 is the dual set of screw threads. Cream dispensing tubes are manufactured with two different standardized diameters for the neck and screw threads. The improved invention accommodates both sizes. Part 6 is a larger set of female screw threads, for tubes with a larger neck diameter. Part 5 is a smaller set of female screw threads, for tubes with a smaller neck diameter. See FIG. 21, which depicts a smaller tube 14 with a smaller neck 16 screwed into the applicator using smaller screw threads 5. Also see FIG. 22, which depicts a larger tube 15 with a larger neck 17 screwed into the applicator using larger screw threads 6. Note that the same applicator can be used with both tube sizes.

The second improved feature of Version 2 is a new applicator mechanism. The components of this new mechanism are a nozzle 8, a tip 3, and a flap 4. The flap is part of the tip but is also partly cut away so as to provide an opening in the tip. When cream is forced out of the tube, it first flows through hole 7 and is then forced into nozzle 8 (see FIG. 8). It then flows through the flap 4 and finally onto the exterior surface of the tip 3. The tip is the part that directly applies cream to the skin. It is preferably made of a soft flexible material such as a rubbery plastic.

As shown in FIGS. 1-4, the tip assumes the form of a wedge. It has width in one direction (roughly the diameter of the rim) and tapered depth perpendicular to the width. Moreover, the tapered depth has concave (inward) curvature on a convex (outward) curvature on opposing faces. The flap 4 is an opening in the concavely curved surface.

Figure 1:
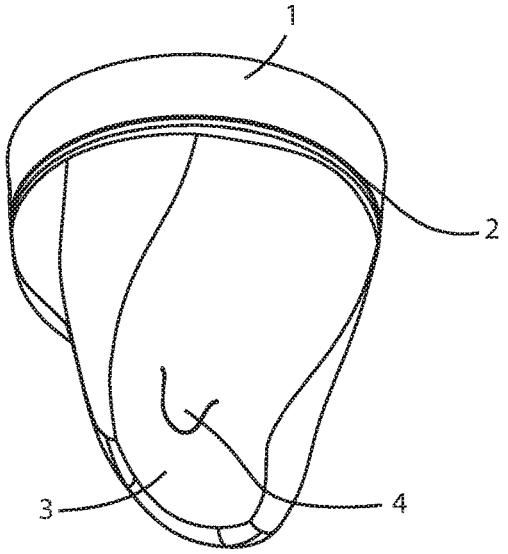
FIG. 1 is a first perspective view of the applicator.
Figure 2:
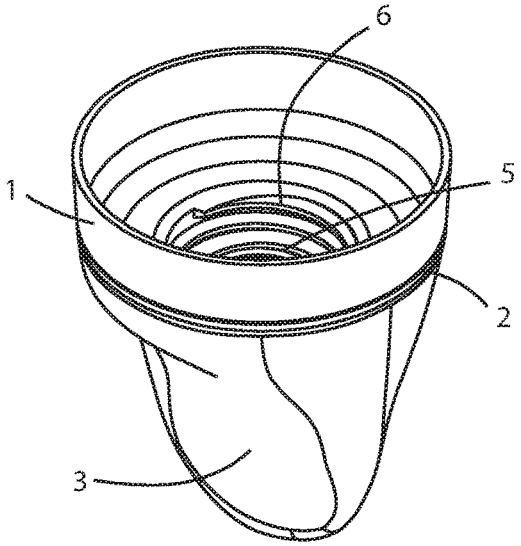
FIG. 2 is a second perspective view of the applicator.
Figure 3:
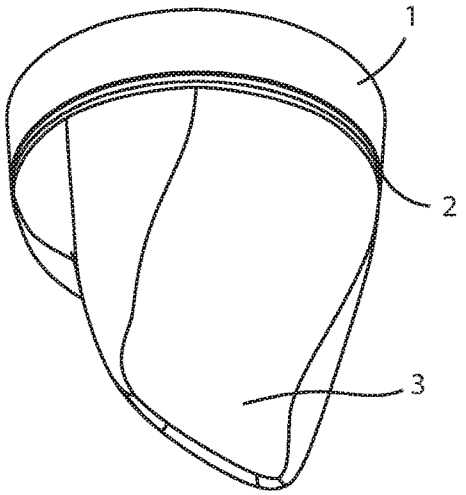
FIG. 3 is a third perspective view of the applicator.
Figure 4:
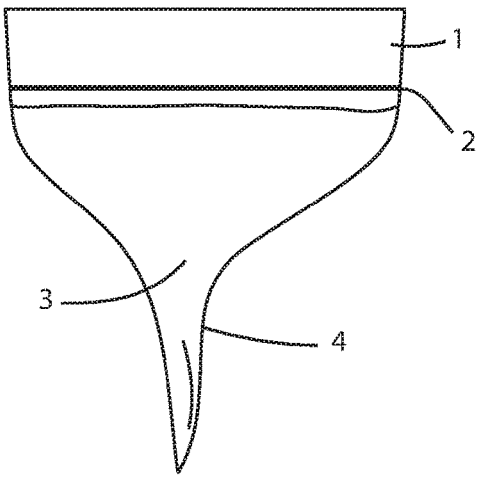
FIG. 4 is a side view of the applicator.
Figure 5:
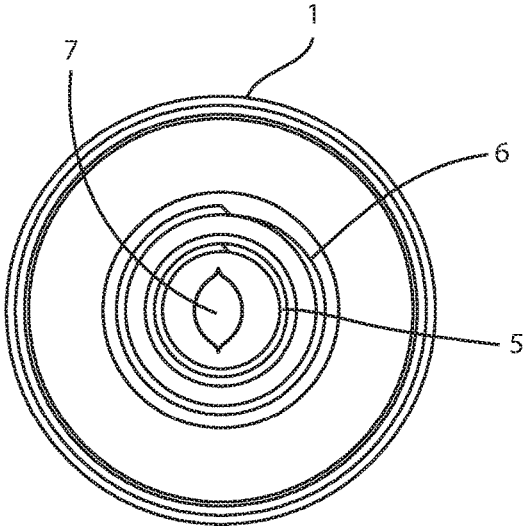
FIG. 5 is a proximal view of the applicator.
Figure 6:
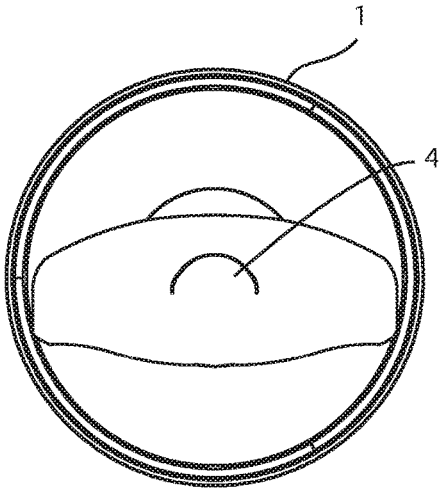
FIG. 6 is a distal view of the applicator.
Figure 7:
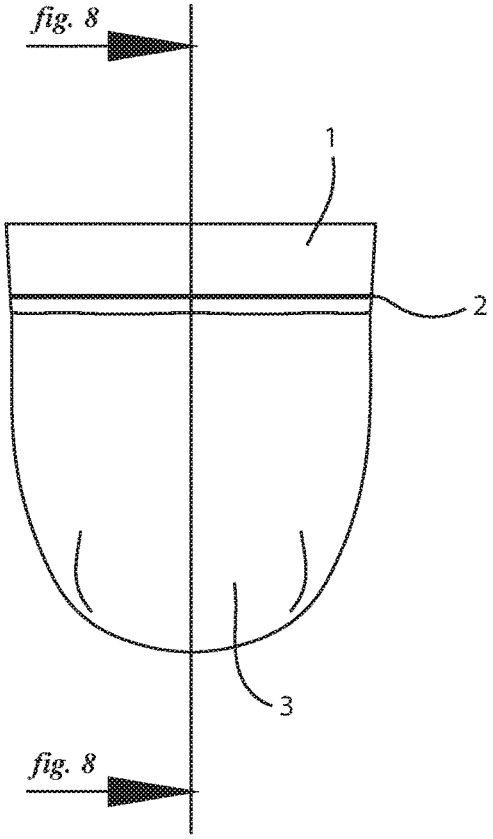
FIG. 7 is a rear view of the applicator.
Figure 8:
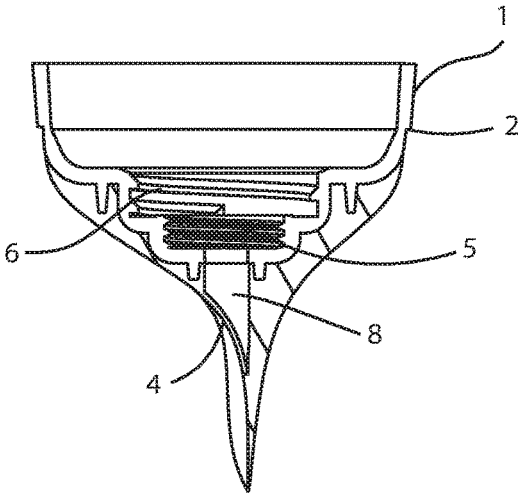
FIG. 8 is a cross-sectional view of FIG. 7.
Figure 9:
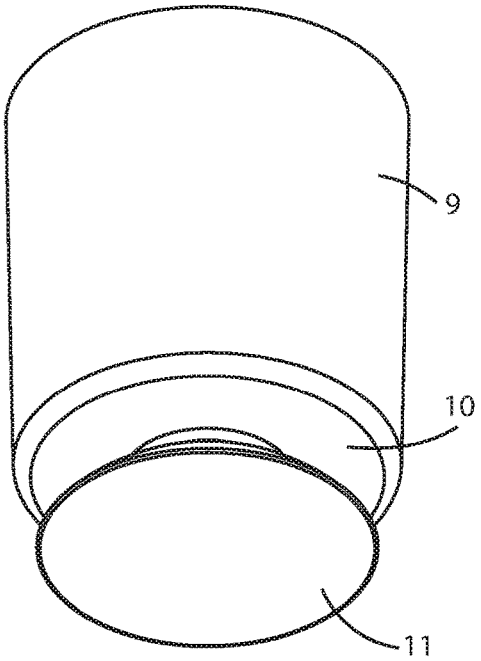
FIG. 9 is a first perspective view of the lid.
Figure 10:
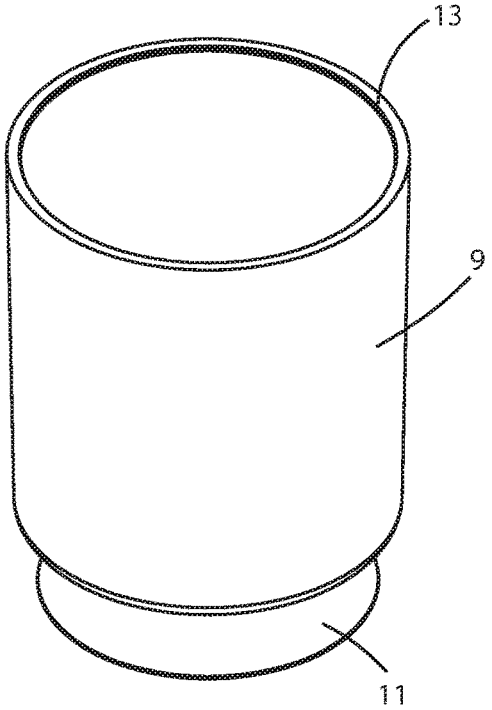
FIG. 10 is a second perspective view of the lid.
Figure 11:
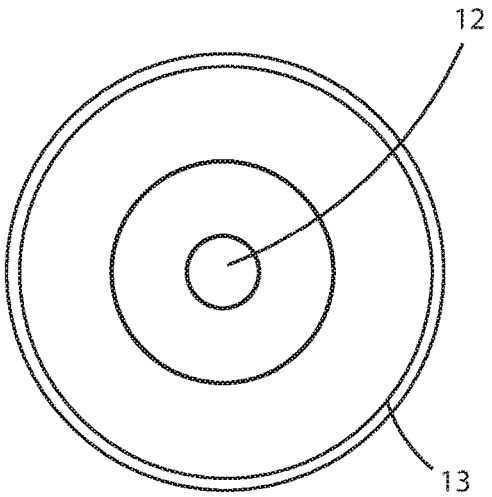
FIG. 11 is a proximal view of the lid.
Figure 12:
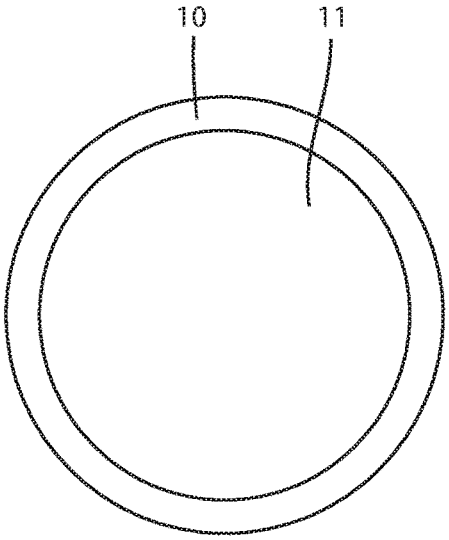
FIG. 12 is a distal view of the lid.
Figure 13:
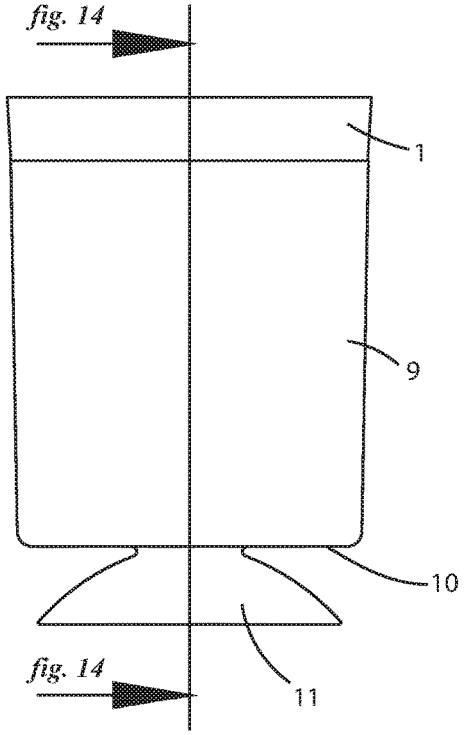
FIG. 13 is a front view of the applicator secured to the lid.
Figure 14:
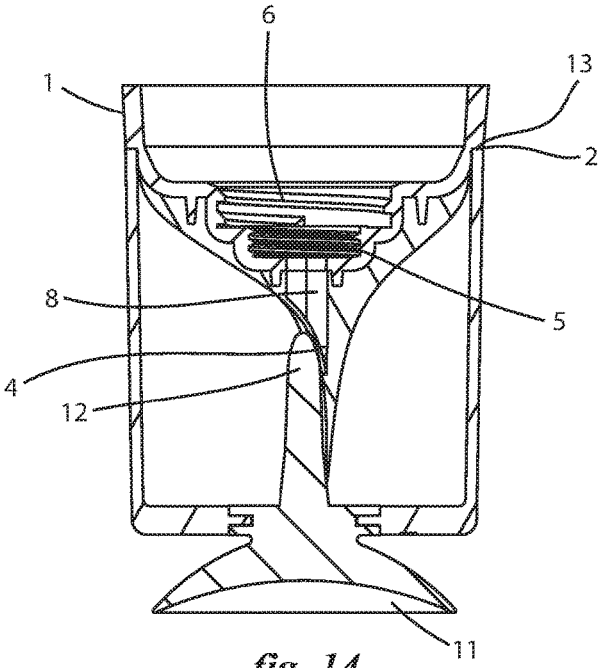
FIG. 14 is a cross-sectional view of FIG. 13.
Figure 15:
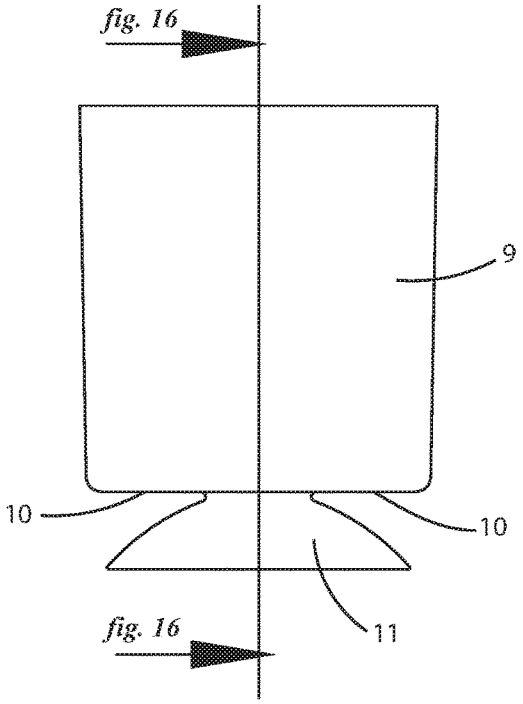
FIG. 15 is a front view of the lid.
Figure 16:
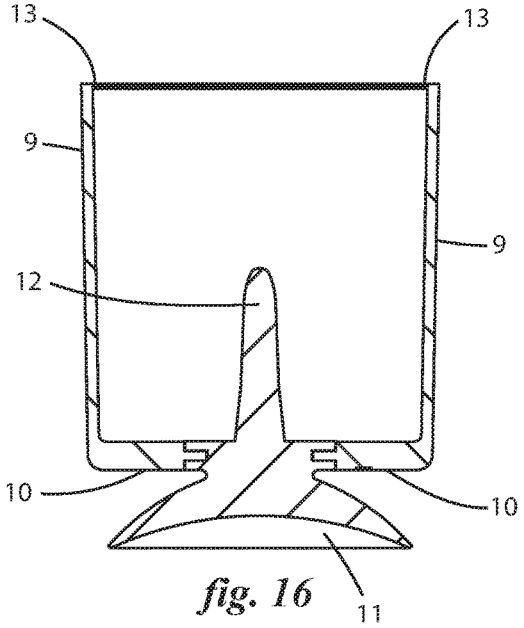
FIG. 16 is a cross-sectional view of FIG. 15.

The third improvement of Version 2 is the tongue in the lid. FIG. 16 shows the interior of the lid, including the tongue 12. The tongue has outward (convex) curvature. In its best mode, the convex curvature of the tongue fits the concave curvature of the tip. When the tube with applicator is fitted into the lid, the tongue presses the tip 3, particularly the flap 4, against the opening of the nozzle 8 as shown in FIG. 14. The seal of the flap against the nozzle keeps the cream from drying out or leaking out of the applicator.

I claim:

1. An improved cream applicator and lid apparatus, comprising:

an applicator with a proximal end and a distal end, comprising a cylindrical rim at the proximal end, an indentation around the rim, larger female screw threads, smaller female screw threads positioned distally from the larger female screw threads so that the larger female screw threads are closer to the cylindrical rim than are the smaller female screw threads, a hole positioned distally from the female screw threads, and cream application means secured distally to the hole;

a lid comprising an open proximal end, a closed distal end, a cylindrical exterior, a lip at the open proximal end fitted to the indentation of the applicator, a base at the closed distal end, said base comprising a proximal surface and a distal surface, and a suction cup secured distally to the base.

2. An improved cream applicator and lid apparatus, comprising:

an applicator with a proximal end and a distal end, comprising a cylindrical rim at the proximal end, an indentation around the rim, female screw threads, a hole positioned distally from the female screw threads, a nozzle extending distally from the hole, a tip secured distally to the rim and making contact with the nozzle, and a flap in the tip where the tip makes contact with the nozzle;

said tip assuming the form of a wedge with two opposing faces wherein one face has a concave curvature and the opposing face has a convex curvature, and said flap positioned in one of the concavely curved surfaces;

a lid comprising an open proximal end, a closed distal end, a cylindrical exterior, a lip at the open proximal end fitted to the indentation of the applicator, a base at the closed distal end, said base comprising a proximal surface and a distal surface, and a suction cup secured distally to the base.

3. The invention of claim 2, wherein the lid further comprises a tongue secured to the proximal surface of the base and extending proximally into the lid;

said tongue having convex curvature complementary to the concave curvature of the tip;

such that, when the applicator is fastened to the lid, the tongue of the lid makes contact with the flap of the applicator.

4. The invention of claim 1, further comprising a nozzle extending distally from the hole, a tip secured distally to the rim and making contact with the nozzle, and a flap in the tip where the tip makes contact with the nozzle;

said tip assuming the form of a wedge with two opposing faces wherein one face has a concave curvature and the opposing face has a convex curvature, and said flap positioned in one of the concavely curved surfaces.

5. The invention of claim 4, wherein the lid further comprises a tongue secured to the proximal surface of the base and extending proximally into the lid;

said tongue having convex curvature complementary to the concave curvature of the tip;

such that, when the applicator is fastened to the lid, the tongue of the lid makes contact with the flap of the applicator.

6. The invention of claim 1, wherein the lid further comprises a tongue secured to the proximal surface of the base and extending proximally into the lid, such that, when the applicator is fastened to the lid, the tongue of the lid makes contact with the applicator.

* * * * *